US008403528B2

(12) United States Patent
Bacon

(10) Patent No.: US 8,403,528 B2
(45) Date of Patent: Mar. 26, 2013

(54) LED AREA LIGHT FIXTURE

(76) Inventor: Douglas Garfield Bacon, Rothesay (CA)

( * ) Notice: Subject to any disclaimer, the term of this patent is extended or adjusted under 35 U.S.C. 154(b) by 206 days.

(21) Appl. No.: 12/932,322

(22) Filed: Feb. 24, 2011

(65) Prior Publication Data

US 2012/0218751 A1 Aug. 30, 2012

(51) Int. Cl.
*F21V 5/04* (2006.01)
*F21V 5/00* (2006.01)
*F21S 4/00* (2006.01)

(52) U.S. Cl. ..... 362/241; 362/249.02; 362/237

(58) Field of Classification Search ..... 362/241, 362/237, 335, 249.02, 218, 153.1, 268, 236, 362/249.01
See application file for complete search history.

(56) References Cited

U.S. PATENT DOCUMENTS

| | | | |
|---|---|---|---|
| 5,361,190 | A | 11/1994 | Roberts et al. |
| 7,758,211 | B2 | 7/2010 | Zheng et al. |
| 2007/0081340 | A1 | 4/2007 | Chung et al. |
| 2009/0154158 | A1 | 6/2009 | Cheng et al. |
| 2009/0196038 | A1 | 8/2009 | Maciel |
| 2010/0103668 | A1 | 4/2010 | Lueken et al. |
| 2010/0118534 | A1 | 5/2010 | Lo |
| 2010/0134046 | A1 | 6/2010 | Holder et al. |

FOREIGN PATENT DOCUMENTS

| | | |
|---|---|---|
| KR | 2008104708 | 12/2008 |
| KR | 946661 | 3/2010 |

*Primary Examiner* — Anh Mai
*Assistant Examiner* — Elmito Breval
(74) *Attorney, Agent, or Firm* — Palmer C. DeMeo; Palmer Patent Consultants, L.L.C.

(57) ABSTRACT

An LED area light fixture for street, roadway or large area illumination including upper and lower, elongated, substantially semi-cylindrical, metallic shells spaced from and attached to each other wherein the upper shell is configured from a plurality of elongated, rectangular, angled strips with a plurality of elongated, rectangular PCB strips attached thereto and a plurality of linearly spaced high intensity LEDs embedded in each of the PCB strips and wherein the lower shell has a plurality of openings therein. A plurality of light diffusing lenses and light focusing cones are positioned in alignment with and between the LEDs and openings in the lower shell for providing uniform illumination below the LED light fixture. A heat conductive means is made integral with the PCB strips and the metallic upper shell in order to dissipate the heat generated by the high intensity LEDs during operation of the LED area light fixture.

38 Claims, 19 Drawing Sheets

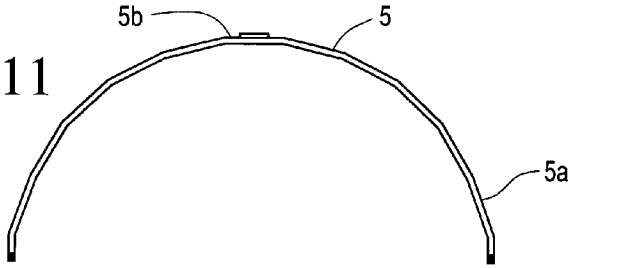
FIG. 11
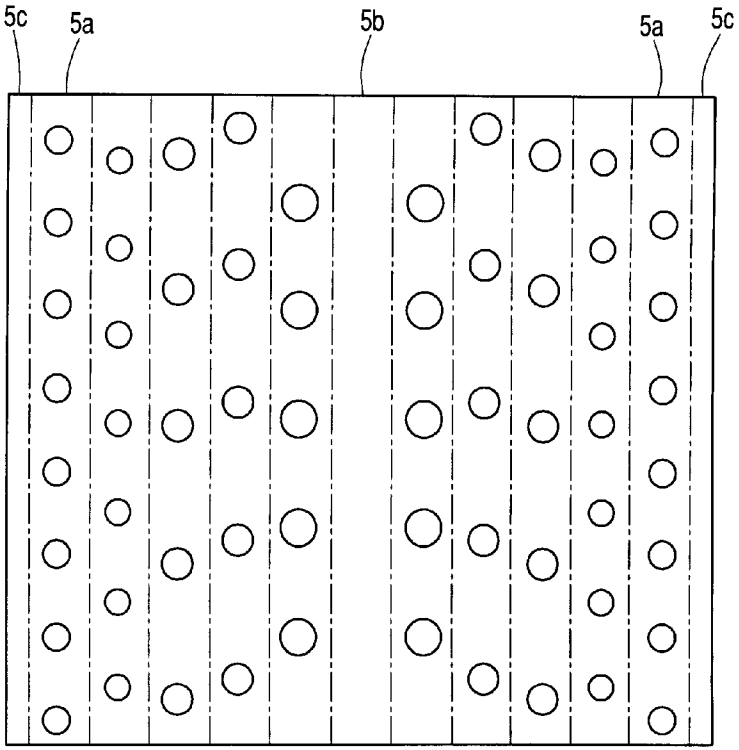
FIG. 13
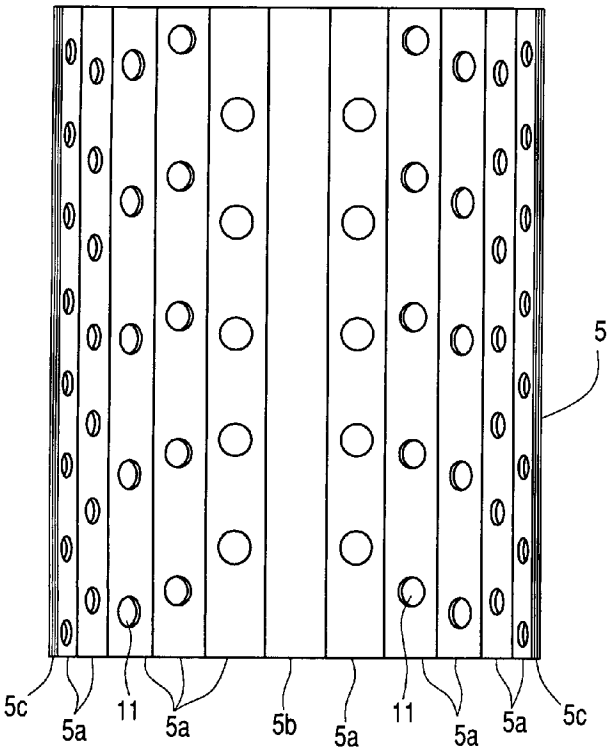
FIG. 10
FIG. 12

LED AREA LIGHT FIXTURE

BACKGROUND OF THE INVENTION

1. Field of the Invention

The present invention relates to an LED area light, using high intensity LEDs, and particularly a fixture therefore for use as a street, roadway or area light.

2. Description of the Related Art

There are many prior patents and publications which disclose the use of LED lights to illuminate large areas such as streets and roadways. Some of these prior patents and publications disclose various techniques or means for dissipating the heat generated by the high intensity LEDs which are used in the prior art LED street or roadway lights such as U.S. 2007/0081340, U.S. 2010/0124059, U.S. Pat. No. 7,758,211 and DERWENT Publication KR 2008104708. Some of these prior patents and publications also disclose LED modules which have various physical arrangements for the LEDs as well as various optical elements or means associated with the LEDs for enhancing or improving the illumination emitted from such prior art LED street or roadway lights such as U.S. 2009/0196038, U.S. 2010/0118534, U.S. 2009/0103288 and DERWENT Publication KR 9446661.

SUMMARY OF THE INVENTION

The present invention discloses a fixture for an LED area light having a unique shape and an optical module for concentrating a high intensity emitted light over a wide area as well as an integral heat sink for effectively dissipating the heat generated from a plurality of high intensity LEDs used therein. The fixture also has a section thereof for housing electronic circuitry for power management.

The LED area light fixture has two main parts which are mechanically connected together. A first part, which is over the illuminated street or area side of the light fixture, contains the LED optical module. The second part, which is on the mounting side of the light fixture, contains electronic components of an LED driver and a controller. The two parts of the light fixture are separated by a ceramic layer which provides thermal insulation therebetween as well as prevents ice creation under certain weather conditions and also keeps the electronic components of the first part from the heat generated by the LED optical module. The LED optical module is contained within an upper and a lower shell joined together in a water tight seal.

The present invention relates to illuminating streets, roadways and common areas using high intensity light emitting diodes (LEDs) housed in a fixture for mounting on existing street, roadway or area poles. Prior high intensity LEDs housed in a fixture have not addressed the need for uniform illumination while providing efficient heat dissipation for extended usage of the fixture.

It is an object of this invention to provide high quality lighting, using low powered light sources such as high intensity LEDs, which is capable of uniformly illuminating a street, roadway or area up to 50 meters (or approx. 200 feet) from pole to pole (or fixture to fixture) and up to 25 meters (or approx. 100 feet) across the street, roadway or area.

It is a particular object of this invention to provide an LED area light fixture capable of dissipating the heat generated by the high intensity LEDs using commonly heat dissipative materials without using bulky heat fins. To accomplish this, the upper shell of the light fixture of this invention is provided with an epoxy powder coated with fine sand added to the mixture (or equivalent materials) so as to create wind resistance (friction) to remove heat from the light fixture. Metal spikes can also be added as an additional heat dissipation means and as a means to deter unwanted birds.

Another object of this invention is to provide an LED configured design layout within the light fixture that is not only capable of uniformly illuminating a street, roadway or large area but is also capable of being managed from a remote location using various modes of communication.

A final object of this invention is to provide for the powering of the light fixture using various means, but not limited to, AC/DC power sources, solar or wind sources.

The preceding objectives, features and advantages together with other objectives, features and advantages will become more apparent from the following more detailed description of the invention, as illustrated in the accompanying drawings in which like reference numerals refer to like parts throughout the different views.

BRIEF DESCRIPTION OF THE DRAWINGS

FIG. 10 is a bottom view of the substantially semi-cylindrical lower shell of the LED light fixture of the present invention.

FIG. 11 is an end view of the substantially semi-cylindrical lower shell shown in FIG. 10.

FIG. 12 is an enlargement of the encircled end structure F of the lower shell shown in FIG. 11.

FIG. 13 is a diagrammatical layout of the lower shell shown in FIG. 10.

DETAILED DESCRIPTION OF THE PREFERRED EMBODIMENTS

FIGS. 1-4 show various views of the LED area light fixture 1 of the present invention attached to a support pole. The LED area light fixture 1 has two main parts: a first part 2, over the area to be illuminated, which contains the optical module including a plurality of high intensity LEDs and a second or rear part 3, attached to the first part 2, houses the electronic components and circuitry for operating the LEDs of the light fixture The second or rear part 3 also contains the hardware for supporting the LED area light fixture 1 to a pole such as a street light pole. The first part 2 of the LED area light fixture 1 is generally angled upwardly from the second part 3 between zero-30 degrees over the area to be illuminated.

Figure 1:
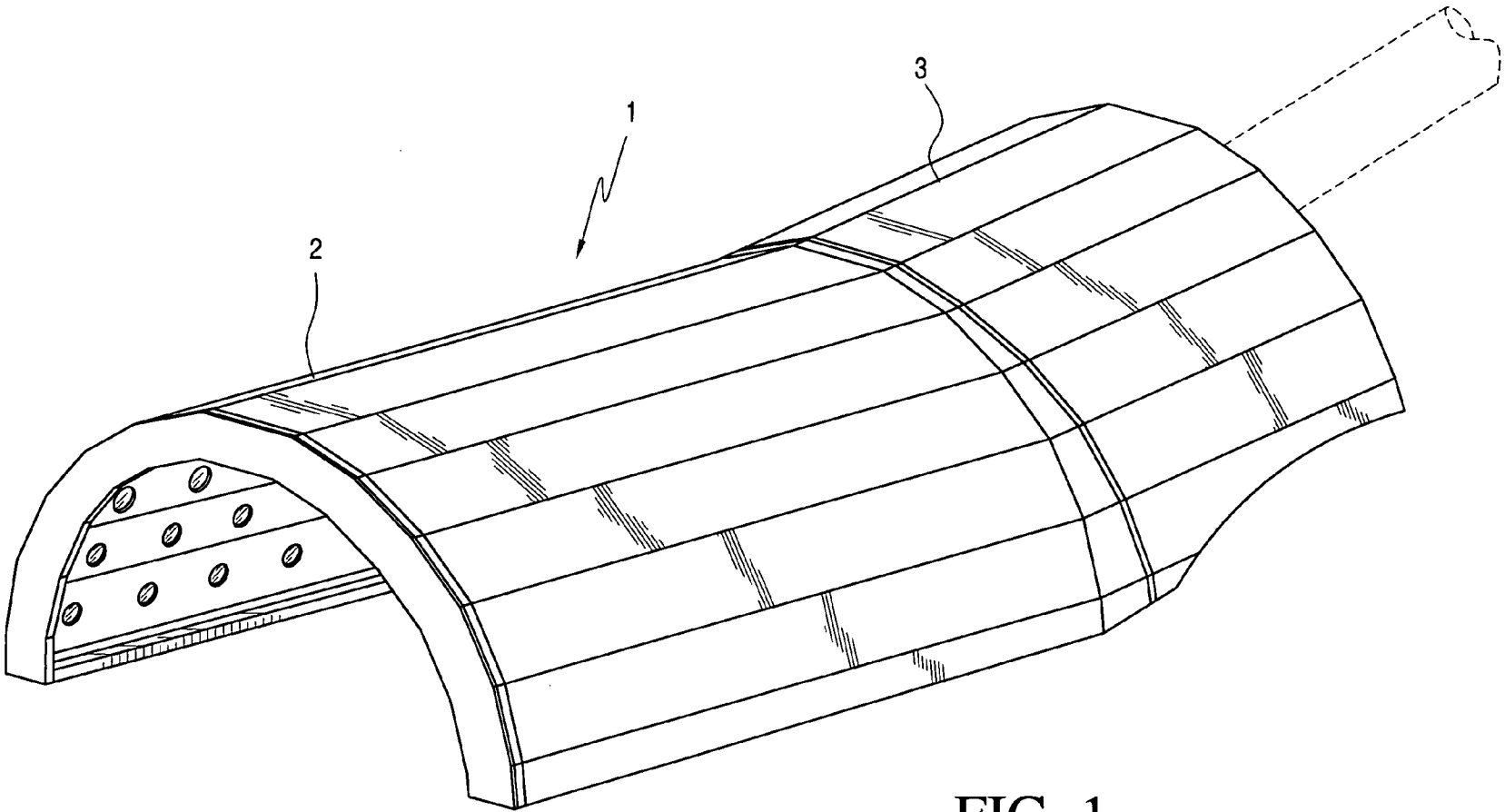
FIG. 1 is a top perspective view of the LED light fixture attached to the end of a support pole.
Figure 2:
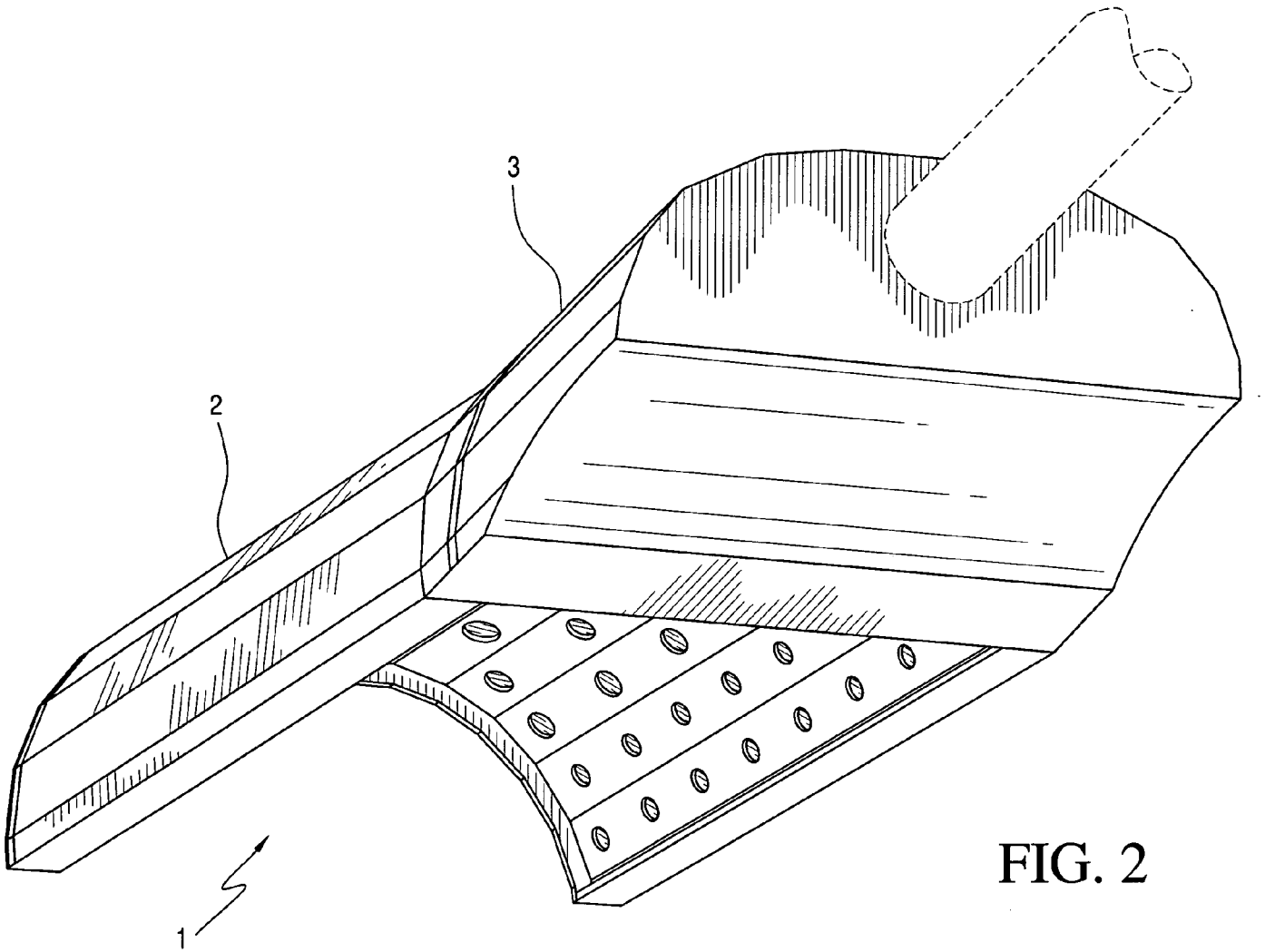
FIG. 2 is a rear/side perspective view of the LED light fixture shown in FIG. 1.
Figure 3:
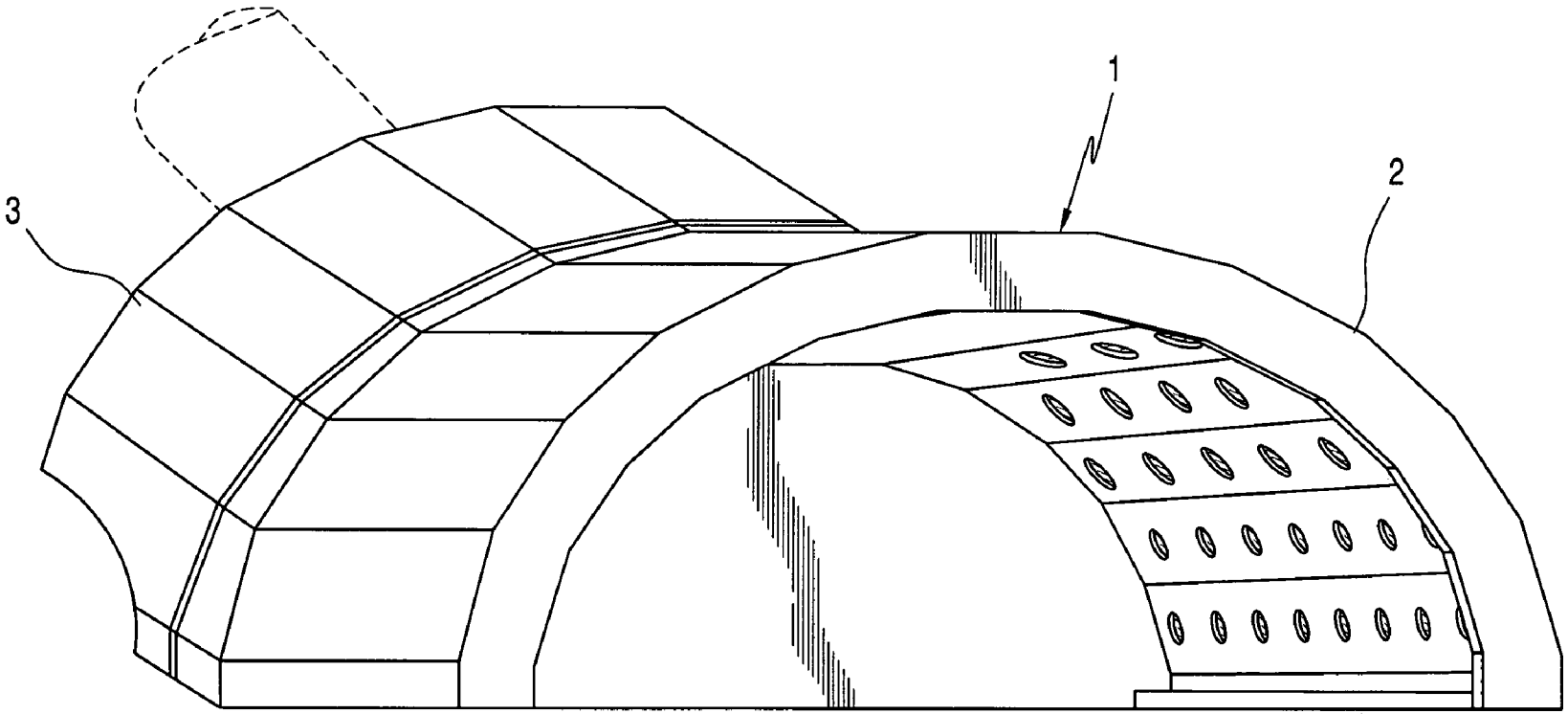
FIG. 3 is a front perspective view of the LED light fixture shown in FIG. 1.
Figure 4:
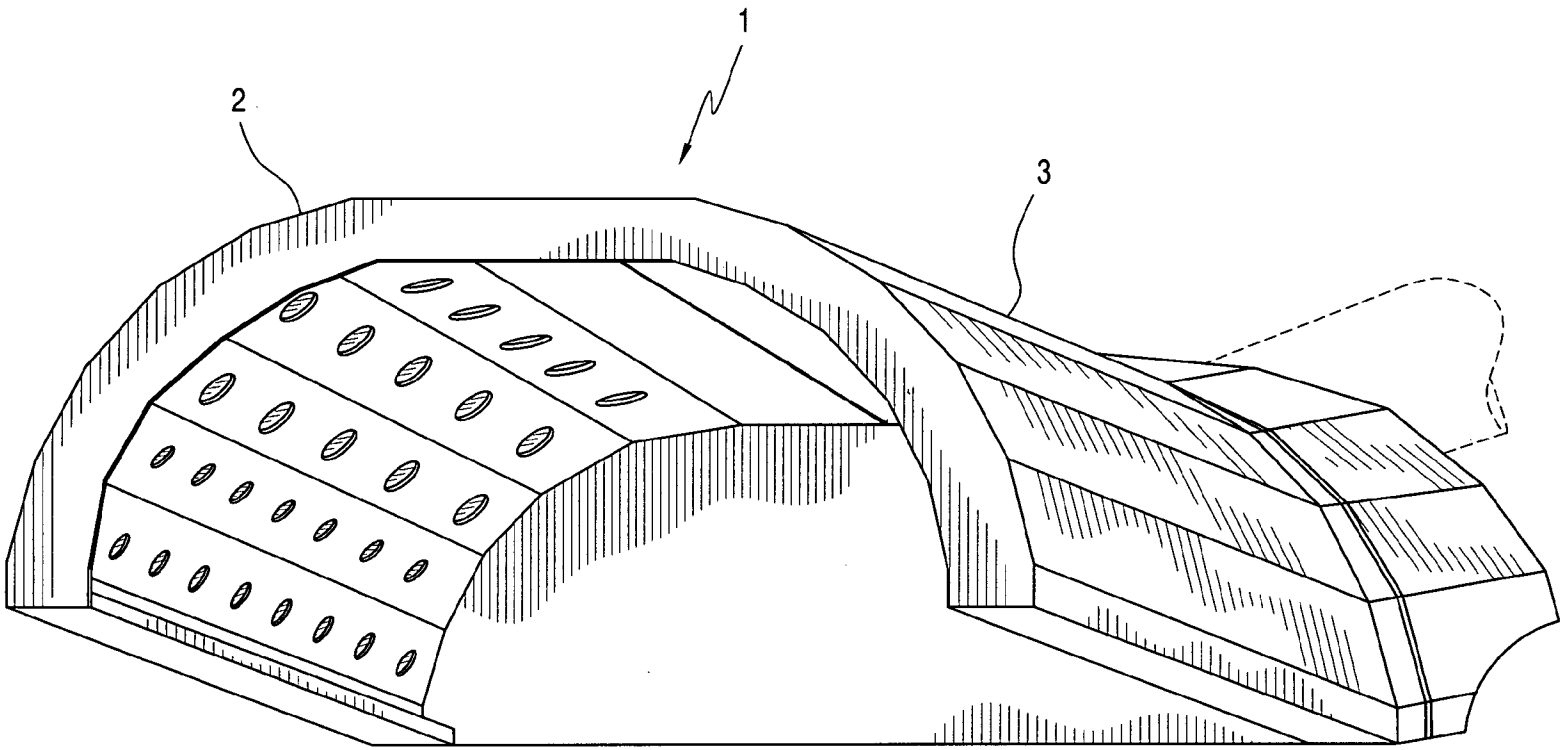
FIG. 4 is a bottom perspective view of the LED light fixture shown in FIG. 1.
Figure 6:
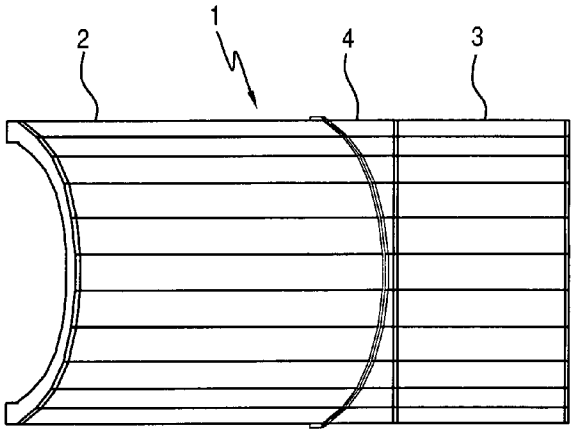
FIG. 6 is a top perspective view of the LED light fixture shown in FIG. 5
Figure 5:
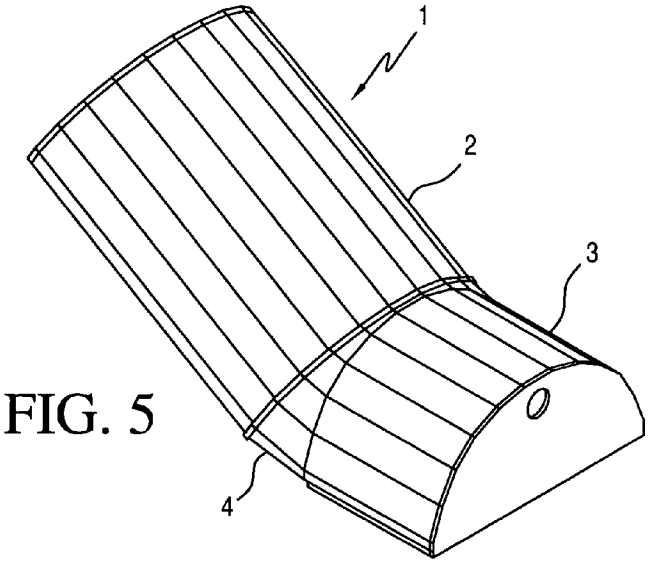
FIG. 5 is another perspective view of the LED light fixture including an optical module, a support/electronics housing and an interconnecting end cap.

FIGS. 5 and 6 show perspective views of the LED area light fixture 1 including a first part 2 or optical module, a second part 3 or support/electronics housing, and an angled interconnector 4 joining the optical module 2 to the housing 3.

Figure 8:
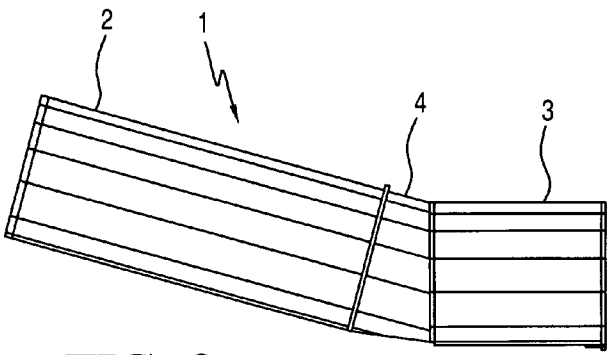
FIG. 8 is another side perspective view of the LED light fixture shown in FIG. 6.
Figure 7:
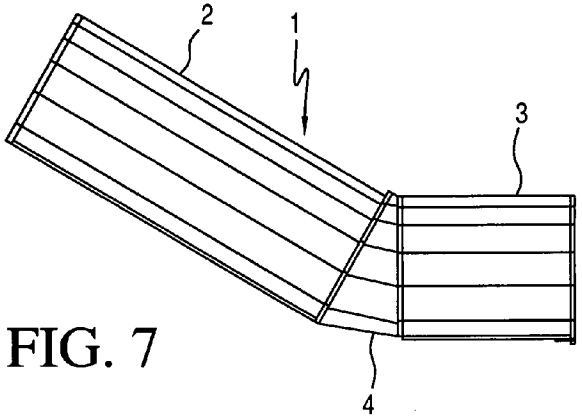
FIG. 7 is a side perspective view of the LED light fixture shown in FIG. 6.

FIG. 7 shows one embodiment of the LED area light fixture 1 of the present invention where the first part 2 or optical module is angled upwardly 30 degrees from the second part 3 or electrical/support housing. FIG. 8 shows another embodiment of the LED area light fixture 1 where the first part 2 or optical module is angled upwardly 15 degrees from the second part 3 or housing. In each of these embodiments an angled interconnector 4 is used between the optical module 2 and the electrical/support housing 3. Although only two embodiments of the orientation of the LED area light fixture 1 are disclosed other orientations may also be used depending on the areas to be illuminated.

Figure 9:
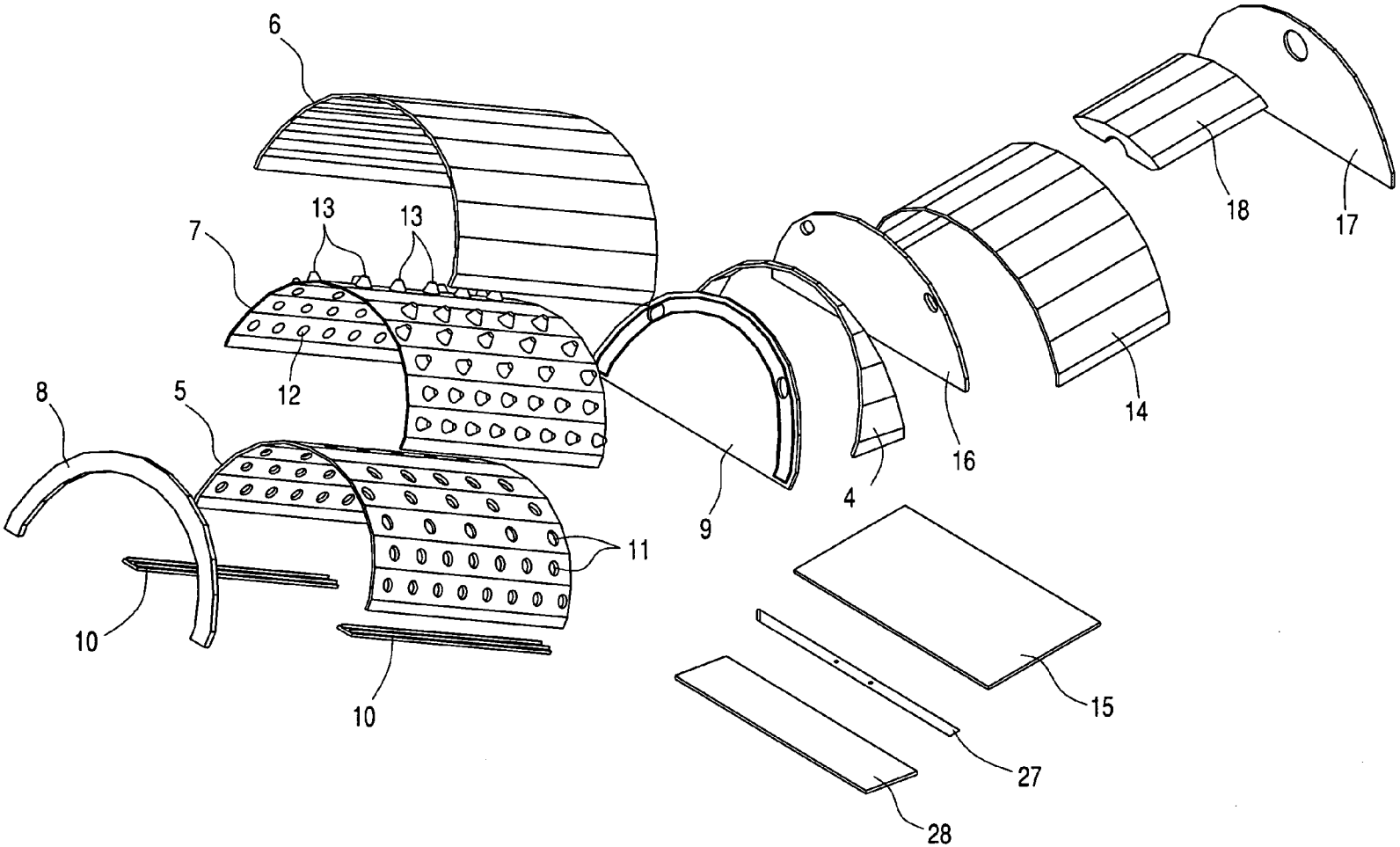
FIG. 9 is an unassembled perspective view of the various parts of the LED light fixture of the present invention.

Referring now to FIG. 9 the various parts of the LED light fixture 1 are discussed here. The first part 2 or the optical module of the present invention is composed of the following elements: an elongated, metallic, substantially semi-cylindrical lower shell 5, an elongated, metallic, substantially semi-cylindrical upper shell 6 spaced from said lower shell 5, another elongated, substantially semi-cylindrical mid-shell 7 spaced from and supported between the lower and upper shells 5 and 6; a front end cap 8, a rear end cap 9, and a pair of assembly brackets 10, 10 for securing and supporting, in conjunction with the front and rear end caps 8 and 9, the upper and lower shells 5 and 6. The upper shell 6 can be manufactured with a smooth outer surface or it can be ribbed so as to optimize heat dissipation. Both the front and rear end caps 8 and 9 are metallic. Also, powder paint with pebbles therein can also be applied to the outer surface of the upper shell 6 in order to create surface air friction and aid in dissipating heat away from the LED light fixture 1. Spikes can also be added to the outer surface of the upper shell 6 in order to keep away birds and insects. The lower shell 5 has a plurality of holes 11 therein and the mid-shell 7 also has a plurality of holes 12 therein in alignment with the plurality of holes 11 in the lower shell 5. The mid-shell 7 supports a plurality of apertured cones 13 aligned with the plurality of holes 12 therein. A more detailed description of these shells will be presented hereinafter. The second part 3 or support/electronics housing includes an upper semi-cylindrical shell 14, a bottom cap or trap door 15, a front cap 16, a rear cap 17, a pole mounting bracket 18, and a piano hinge 27 (preferably made of stainless steel) which is attached, by appropriate screws, to the front cap 16 of housing 3 and bottom cap or trap door 15 for opening the bottom cap or trap door 15. The trap door 15 is attached at its opposite end to the rear cap 17 of the housing 3 by screws or other appropriate means. The LED light fixture 1 is sealed from the environment when the trap door 15 is closed. In between the rear end cap 9 of the optical module 2 and the housing 3 is an angled interconnector 4 for joining and securing the optical module 2 and housing 3 together. A bottom cap 28 is attached to the angled interconnector 4. All the parts of the assembly shown in FIG. 9 (except for the piano hinge 27) for the LED area light fixture 1 are metallic preferably aluminum.

Figure 31:
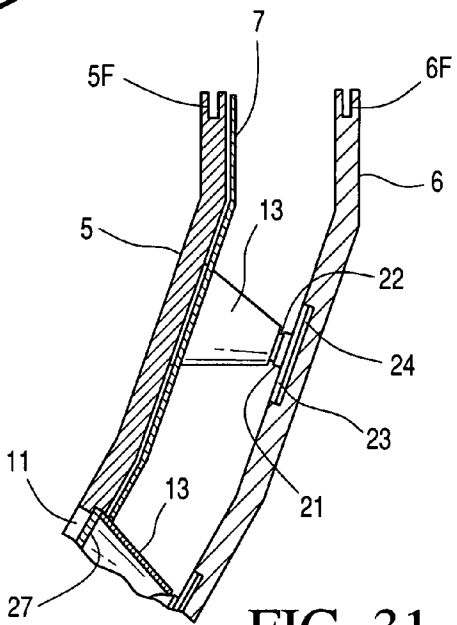
FIG. 31 is a detailed enlargement of the circled area E shown in FIG. 30.

Referring now to FIGS. 10-13. FIG. 10 is a bottom view of the lower shell 5 of the LED area light fixture 1 of the present invention. The lower shell 5 has a plurality of elongated, rectangular, angled sections 5*a* with a plurality of openings 11 in each of the elongated, rectangular, angled sections 5*a*. The angled sections 5*a* of the lower shell 5 are angled progressively and approximately (as shown in FIGS. 11), i. e., 70°, 60°, 44°, 28°, and 14°. The lower shell 5 also includes a non-apertured, uppermost, elongated, rectangular, horizontal section 5*b* and non-apertured, lowermost, elongated, rectangular, perpendicular sections 5*c*, 5*c*. The left side of the lower shell 5 is a mirror image of the right side of the lower shell 5. FIG. 12 shows a detailed enlargement of the circled area F shown in FIG. 11. Alternatively, the left side of the lower shell 5 could also be a non-mirror image of the right side depending on the particular application of the LED area light fixture 1. Each of the lowermost sections 5*c* has a female connecting structure for securing the lower shell 5 to an assembly bracket 10 to be explained later. In a preferred embodiment the dimensions of the semi-cylindrical lower shell 5, for example, are approximately 15 inches wide, 19 inches long, 3/16 inch thick as shown in FIGS. 10-12. The width of each elongated, rectangular, angled section 5*a* of the lower shell is approximately 1 and 27/32 inches, the width of the uppermost section 5*b* is approximately 1 and 27/32 inches and the width of each of the lower sections 5*c* is approximately 3/4 inch. Referring now more specifically to FIGS. 10 and 13. The lower shell 5 has a number of openings 11 in each of the elongated, rectangular, angled sections 5*a*, on the outer or bottom side of the lower shell 5 there are through openings 11 therein and on the inner side of the lower shell 5 there is a counter-bore (not shown in FIGS. 10 and 13) at each of the through openings 11. Each of the counter-bores will accommodate a circular light diffusing lens 27 made out of glass or plexiglass (not shown in FIGS. 10 or 11). The circular light diffusing lens 27 is pressure fitted into a respective counter-bore and may be sealed in the counter-bore with silicone or some other sealing adhesive in order to help hermetically seal the LED area light fixture 1. In a preferred embodiment, on one side of the lower shell 5, each of the angled sections 5*a* has several openings 11 therein, the lowermost section 5*a* has 8 linearly spaced openings, the next section 5*a* has 7 linearly spaced openings, and each of the following three sections 5*a* has 5 linearly spaced openings. The openings 11 in one elongated, rectangular, angled section 5*a* are staggered with respect to the openings 11 in an adjacent elongated, rectangular, angled section 5*a* as shown in FIGS. 10 and 13. This pattern of openings 11 in the lower shell 5 is repeated on the opposite side of the lower shell 5 since one side thereof is a mirror image of the other. The total number of openings 11 in the lower shell 5 is preferably 60 but could be less depending on the particular application for the LED area light fixture 1. The openings 11 in the lower shell 5 have different inner diameters and counter-bore diameters. For example, in a preferred embodiment of the LED area light fixture 1 of the present invention, the inner diameter of each opening 11 in the two lower, adjacent, angled sections 5*a* is approximately 23/32 inch and the diameter for each of the corresponding counter-bores in those angled sections 5*a* is approximately 13/16 inch. In the following two higher, adjacent, angled sections 5*a*, the inner diameter of each opening 11 is approximately 7/8 inch and the diameter for each of the corresponding counter-bores is approximately 15/16 inch. In the following uppermost, adjacent, angled section 5*a*, the inner diameter of each opening 11 is approximately one inch and the diameter for each of the corresponding counter-bores is approximately one and 1/16 inches. These diameters for the openings 11 and their respective counter-bores are the same for the angled sections 5*a* on both sides of the lower shell 5 since each side is the mirror image of the other. A light diffusing lens 27 (FIGS. 25 and 31) with the proper diameter is inserted into each of the counter-bores in the lower shell 5. Referring again to FIG. 12, the female groove in each of the lowermost sections 5*c* of the lower shell 5 has a depth of approximately 3/16 inch and a width of approximately 1/16 inch. The lower shell 5 is supported by the assembly brackets 10, 10 and the front and rear end caps 8 and 9. In a preferred embodiment of the present invention, there are 60 openings 11 and corresponding counter-bores in the lower shell 5. The structure of the lower shell 5 with the positioning of the openings 11 therein is a critical part of the LED light fixture 1 of the present invention.

Figure 18:
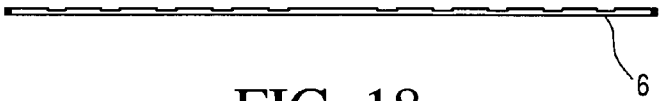
FIG. 18 is a flat depiction of the upper shell shown in FIG. 15.
Figure 17:
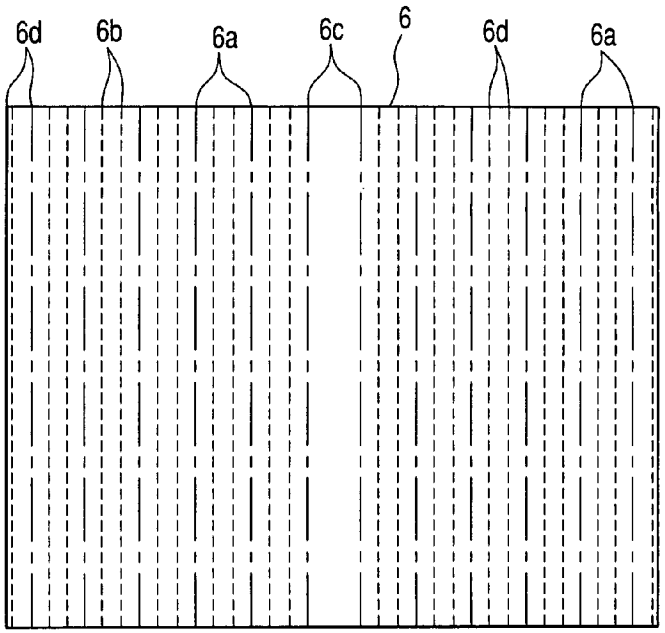
FIG. 17 is diagrammatical layout of the upper shell shown in FIG. 14.
Figure 16:
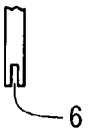
FIG. 16 is an enlargement of the encircled end structure G shown in FIG. 15.
Figure 15:
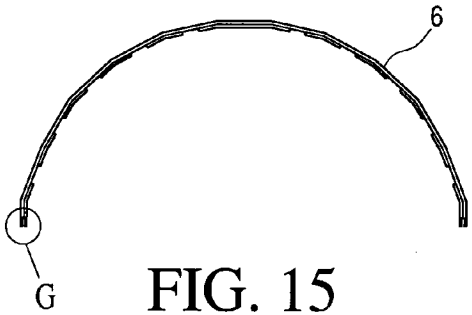
FIG. 15 is an end view of the substantially semi-cylindrical upper shell shown in FIG. 14.
Figure 14:
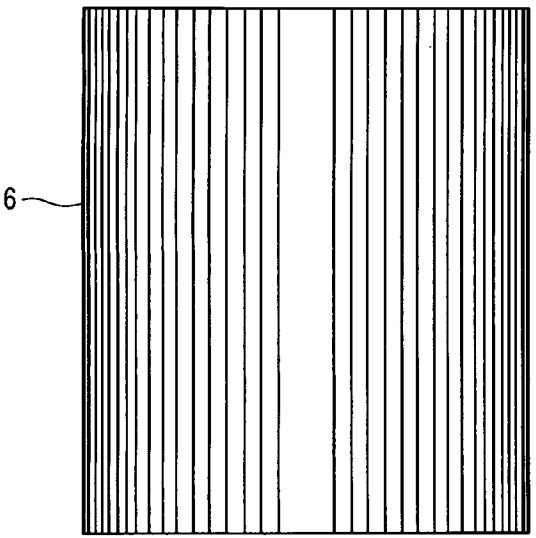
FIG. 14 is a bottom view of the substantially semi-cylindrical upper shell of the LED light fixture of the present invention.

Referring now to FIGS. 14-18. FIG. 14 shows a bottom view of the upper shell 6 of the LED area light fixture 1 of the present invention. The upper shell 6 is divided into two sections, one side being the mirror image of the opposite side. Alternatively, the left side of the upper shell 6 could also be a non-mirror image of the right side depending on the particular application of the LED area light fixture 1. Each side of the upper shell 6 has five elongated, rectangular, angled sections 6*a* and an elongated, rectangular, end section 6*d*. An uppermost elongated, rectangular section 6*c* has the same width as the elongated, rectangular, angled section 6*a*. The structure of the upper shell 6 is similar to that of the lower shell 5 with each of the elongated, angled sections 6*a* being angled at the same angle as the corresponding, elongated, angled section 5*a* in the lower shell 5. Each angled section 6*a* of the upper shell 6 has an elongated, rectangular groove 6*b* in which is inserted a respective printed circuit board (PCB) with embedded LED's (PCBs not shown in these figures but which will be shown and discussed later). Each elongated, rectangular groove 6*b* has a width of approximately 3/4 inch and a depth of approximately 1/16 inch. The thickness of the upper shell 6 is approximately 3/16 inch. In a preferred embodiment of the LED area light fixture 1 of the present invention, the width of the semi-cylindrical upper shell 6 is approximately 17 inches and its length is approximately 19 and 1/2 inches. FIG. 17 shows a diagrammatical layout of the upper shell 6 with the divisions of the elongated, rectangular, angled sections 6*a* and the elongated, rectangular grooves 6*b* therein, the elongated, rectangular, uppermost section 6*c* and the two elongated, rectangular, end sections 6*d*. FIG. 18 shows a stretched-out end view of the upper shell 6. The upper shell 6, which is metallic, is preferably made of aluminum as is the lower shell 5. The upper shell 6 is supported by the assembly brackets 10, 10 and the front and rear end caps 8 and 9. FIG. 16 shows a detailed enlargement of the circled area G shown in FIG. 15. Each of the lowermost sections 6*d* of the upper shell 6 has a female connecting structure for securing the upper shell 6 to an assembly bracket 10 to be explained later.

Figure 20:
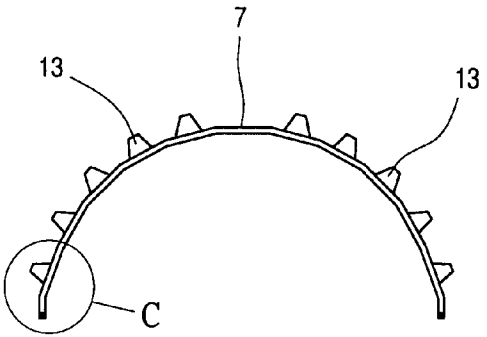
FIG. 20 is an end view of the inner shell shown in FIG. 19.
Figure 19:
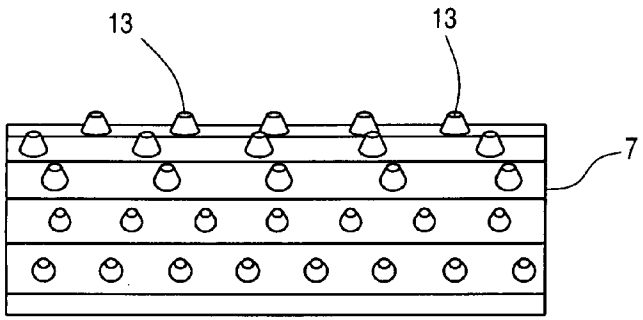
FIG. 19 is a side perspective view of an apertured, substantially, semi-cylindrical, inner shell for supporting a plurality of apertured light focusing cones.
Figure 21:
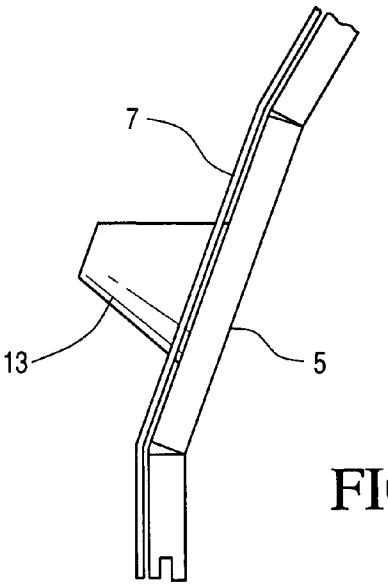
FIG. 21 is a detailed enlargement of the circled area C shown in FIG. 20.

Referring now to FIGS. 9, 19, and 20. The inner shell 7 has a substantially, semi-cylindrical shape similar to those of the lower and upper shells 5 and 6. The inner shell 7 has a structure including elongated, rectangular, angled sections (not numbered) several of which are angled similar to the elongated, rectangular, angled sections 5*a* and 6*a* in the lower and upper shells 5 and 6. The inner shell 7 also has a plurality of openings 12 (shown in FIG. 9) therein corresponding with and in alignment with the openings 11 in the lower shell 5. A light focusing cone 13, having a through hole, is affixed to each of the plurality of openings 12 therein. Each of the light focusing cones 13 has a larger opening at one end thereof which end is attached to the inner shell 7 but protrudes slightly therefrom. Each end of the light focusing cones 13, with the larger opening, extends within a respective counter-bore in the lower shell 5 and abuts a respective light diffusing lens 27 within that counter-bore (best shown in FIG. 31). Each of the light focusing cones 13 has a smaller opening at its opposite end which end will encompass a respective LED in the PCB strip 20 attached to the inner side of the upper shell 6 as will be explained later. The inner shell 7 and light focusing cones 13 are formed integral with each other and may be molded from plastic; the focusing cones 13 may be zinc plated on their inner surfaces. Alternatively, the inner shell 7 and light focusing cones 13 may be made from metal, for example, aluminum or some other appropriate material such as zinc plated plastic. When assembled, the inner shell 7 is supported by pressure between the lower shell 5 and the upper shell 6. FIG. 21 is a detailed enlargement of the circled area C in FIG. 20 showing the end structure of the lower shell 5, the inner shell 7, and one of the focusing cones 13. Each of the focusing cones 13 has a total height of approximately 11/16 inch. The structure of the light focusing cone 13 is shown in FIGS. 26 A, B, C and D. The inner shell 7, per se, is spaced from the lower shell 5 by approximately 1/32 inch and has a thickness of approximately 1/32 inch.

Figure 22:
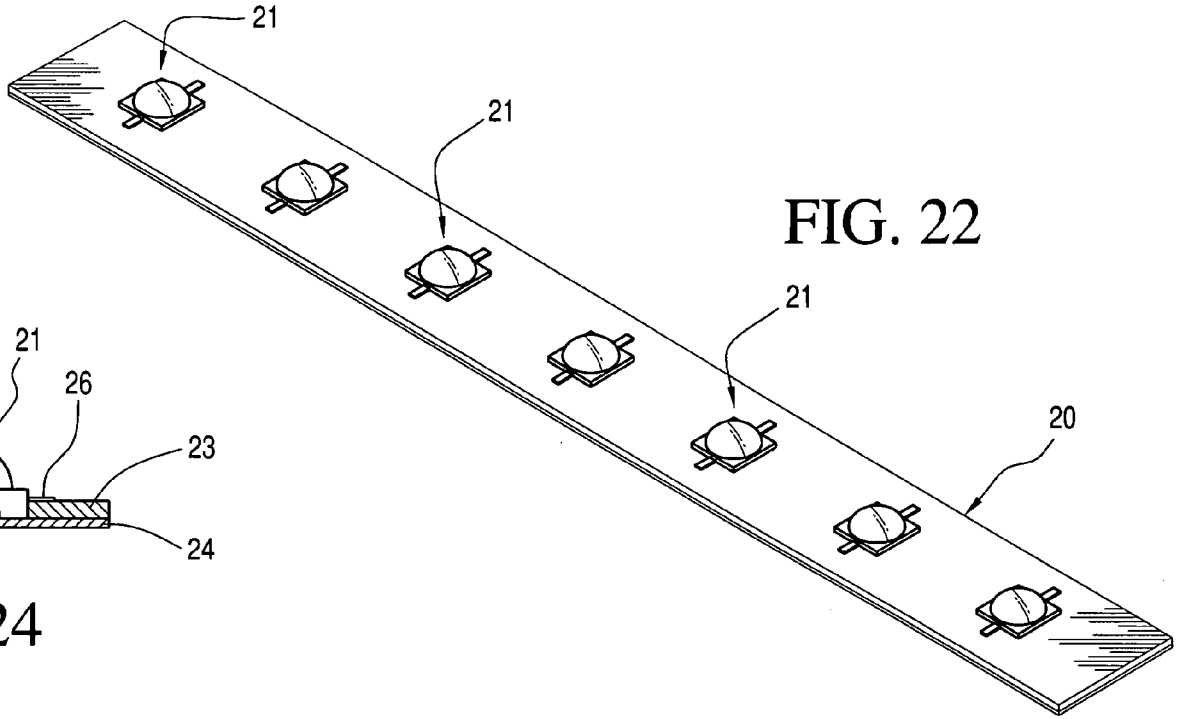
FIG. 22 is a perspective view of one of the elongated, rectangular, PCB strips inserted into an elongated, rectangular groove in the upper shell.
Figure 24:
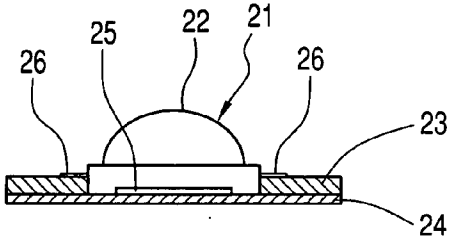
FIG. 24 is a cross sectional view taken through line 24-24 of FIG. 23.
Figure 23:
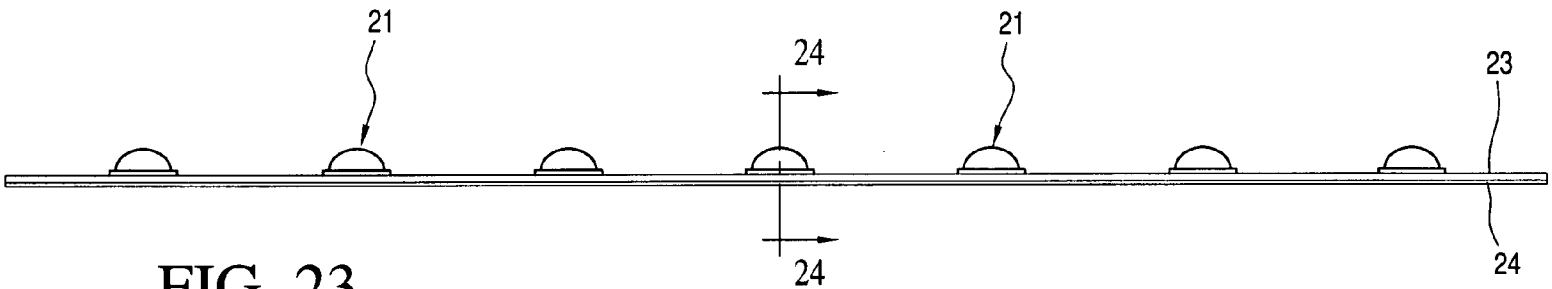
FIG. 23 is a side view of the PCB strip shown in FIG. 22.

Referring now to FIGS. 22, 23, and 24. FIG. 24 shows one of the 10 elongated, rectangular, PCBs strips 20 of the optical module 2 of the present invention. Each PCB strip 20 extends approximately the length of the upper shell 6 and has a height of approximately 1/16 inch (excluding the LED embedded therein). Each of the PCB strips 20 has a number of linearly spaced high intensity LEDs 21 embedded in a PCB layer 23. Each LED 21 has a conventional light transparent, semi-spherical lens 22 attached thereto and a backing layer 25 which backing layer 25 is fused to a copper backing layer 24 which, in turn, is attached to the inner surface of the upper shell 6. The copper backing layer 24 aids in dissipating the heat generated from the high intensity LEDs 21 during operation of the LED optical module 2 of this invention. Each of the LEDs in a given PCB strip 20 has a pair of electrically conductive leads 26, 26 connected to and extending therefrom. There are ten of these PCB strips 20, each of which is pressure fitted into a respective elongated, rectangular, groove 6*b* in the upper shell 6 (see FIGS. 17 and 18). In a preferred embodiment of the LED light fixture 1 of the present invention, one PCB strip 20 with seven LEDs 21, linearly and evenly spaced along its length, is inserted into and fixed within each of the grooves 6*b* in the two lower most angled sections 6*a* on opposite sides of the upper shell 6 and another PCB strip 20 with five LEDs 21, linearly and evenly spaced along its length, is inserted into and fixed within each of the grooves 6*b* of the three succeeding angled sections 6*a* on opposite sides of the upper shell 6. Each of the high intensity LEDs 21 in the PCB strips 20 attached to the upper shell 6 is aligned with and corresponds with a respective opening 11 in the bottom shell 6, a respective trough-hole in the light focusing cone 13 and with a respective opening 12 in the inner shell 7. Elongated electrically conductive leads (not shown in the figures for simplicity sake) extend from each pair of LED electrically conductive leads 26, 26 through openings 9A, 9A in the rear end cap 9 of the optical module 2 and thence through openings 16A, 16A of the housing front cap 16 connecting to the electronics control unit 29 (shown in FIG. 56) in electrical/support housing 3. The elongated electrically conductive leads extending from all of the electrically conductive LED leads 26, 26 are arranged in the form of harnesses.

Figure 25A:
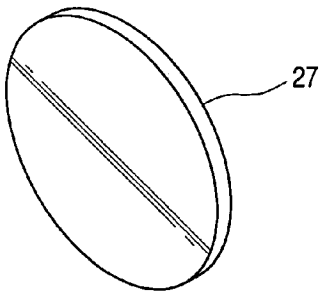
FIG. 25A is a perspective view of the light diffusing lens used in the optical module of this invention.
Figure 25B:
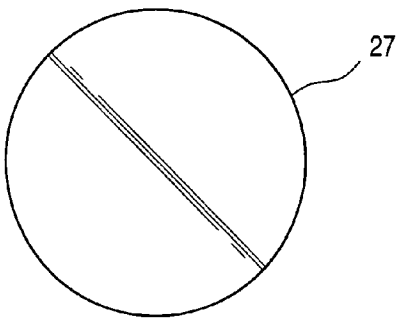
FIG. 25B is a top planar view of the light diffusing lens shown in FIG. 25A.
Figure 25C:
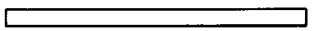
FIG. 25C is a side view of the light diffusing lens shown in FIG. 25B.

Referring now to FIGS. 25A, B, and C. These figures show a circular light diffusing lens 27 which is inserted into a counter-bore in the lower shell 5 of the optical module 2 of the present invention. This circular light diffusing lens 27 comes in three different sizes with diameters of approximately 13/16 inch, 15/16 inch and 1 1/4 inches to fit into the three different sized counter-bores in the lower shell 5; they are press fitted into the counter-bores in the lower shell 5 and sealed therein with silicone or some other appropriate adhesive to aid in making the LED area light fixture 1 weather proof.

Figure 26A:
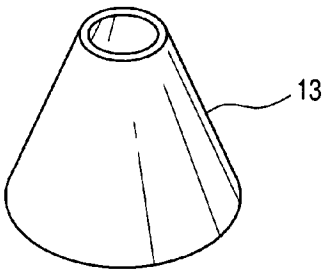
FIG. 26A is a perspective view of the light focusing cone used in the optical module of this invention.
Figure 26B:
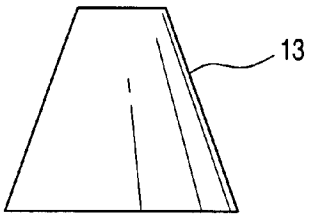
FIG. 26B is a side view of the light focusing cone shown in FIG. 26A.
Figure 26C:
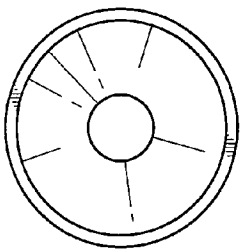
FIG. 26C is a top view of the light focusing cone shown FIG. 26A.
Figure 26D:
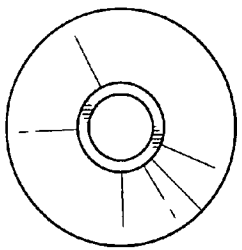
FIG. 26D is a bottom view of the light focusing cone FIG. 26A.

Referring to FIGS. 26A, B, C and D. These figures show a light focusing cone 13 with an opening therethrough. The light focusing cone 13 also comes in three different sizes to also partially fit into the counter-bores corresponding to the counter-bores in which the light diffusing lens 27 are inserted. Each of these light diffusing cones 13 is integral with its support shell 7 but extends slightly therefrom at its larger end. Each of these light diffusing cones 13, at its larger end, is partially inserted into a respective counter-bore and in contact with a respective light diffusing lens 27 during the assembly of the optical module 2 (see FIG. 31).

Figure 28:
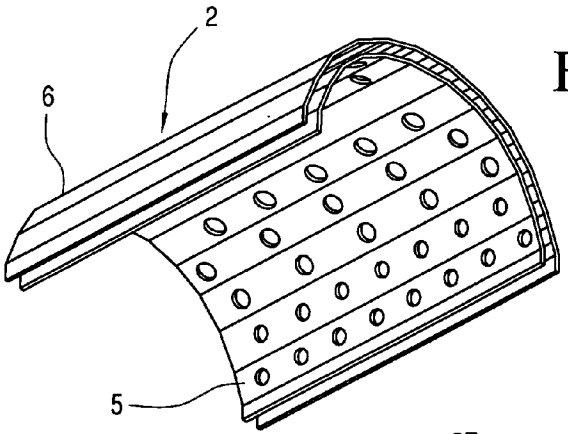
FIG. 28 is a perspective view of the optical module of the present invention.
Figure 27:
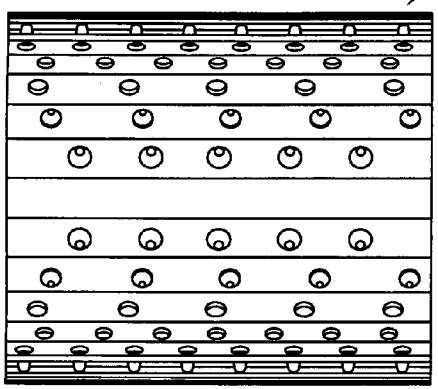
FIG. 27 is a bottom view of the optical module of the LED light fixture of the present invention.
Figure 30:
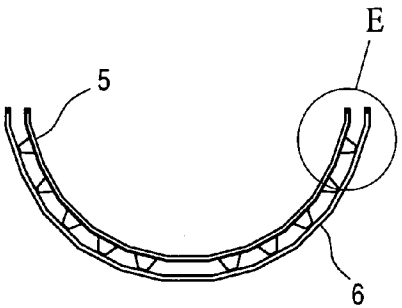
FIG. 30 is a cross-sectional view of the optical module taken through line 30-30 shown in FIG. 29.
Figure 29:
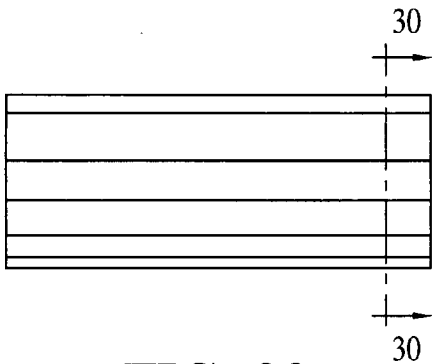
FIG. 29 is a side view of the optical module of the present invention.

Referring now to FIGS. 27-31. These figures show the assembly of the optical module 2 of the LED area light fixture 1 of the present invention. The cross-sectional view shown in FIG. 30, taken along line 29, 29 of FIG. 29, shows the assembly of the lower shell 5, the upper shell 6, and the inner shell 7 with the light focusing cones 13. In particular, FIG. 31 (an enlargement of the circled area E of FIG. 30) shows in detail the smaller diameter end of the light focusing cone 13 surrounding and in engagement with the lens 22 of the LED 21 and the larger diameter end of the light focusing cone 13 in engagement with the light diffusing lens 27 which, in turn, is fixed within a counter-bore of an opening 11 in the lower shell 5. Thus, when the upper and lower shells 5 and 6 are secured together by the front and rear end caps 8 and 9 and by the assembly brackets 10, 10 (as will be later explained further) the inner shell 7, with its focusing cones 13, becomes fixed between the lower and upper shells 5 and 6. The overall width of the assembled optical module 2 shown in FIGS. 28 and 30 is approximately 3/4 inch.

Figure 34:
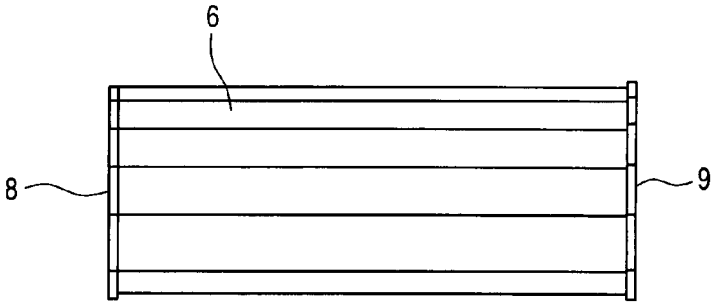
FIG. 34 is another side view of the optical module of the present invention.
Figure 32:
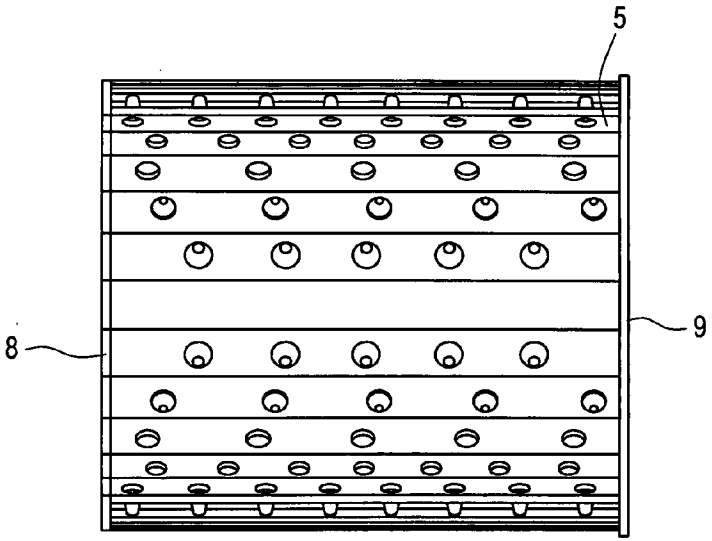
FIG. 32 is another bottom view of the optical module of the LED light fixture of the present invention.
Figure 33:
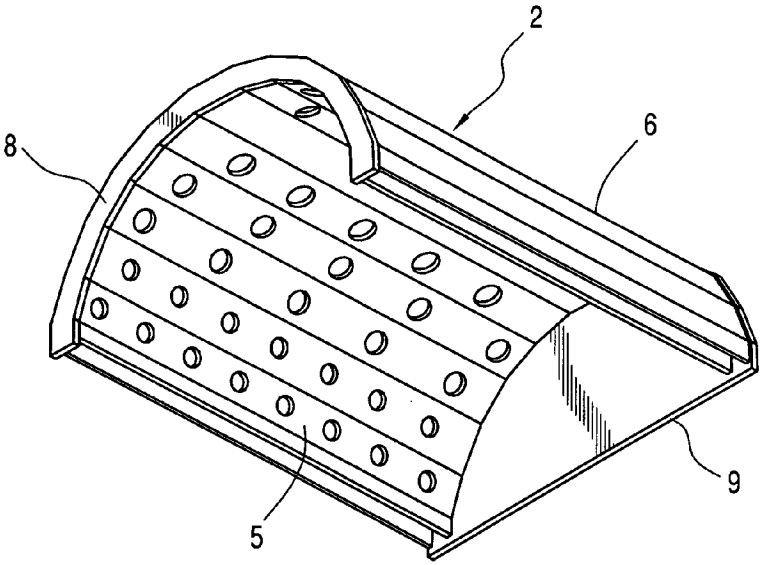
FIG. 33 is another perspective view of the optical module of the present invention.

Referring now to FIGS. 32-34. These figures show the assembly of the optical module 2 including the upper and lower shells 5 and 6, the front and rear end caps 8 and 9.

Figure 35:
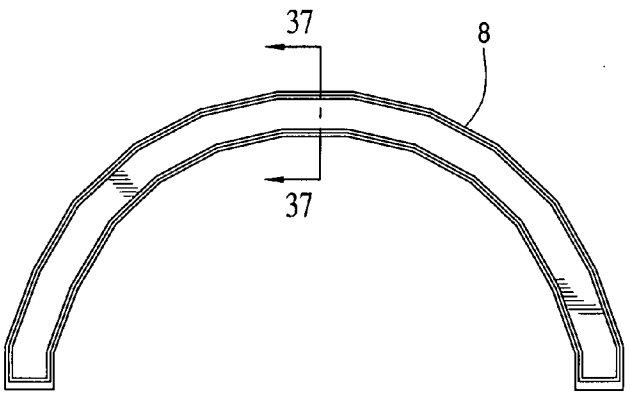
FIG. 35 shows a front view of the front end cap of the optical module of the present invention.
Figure 37:
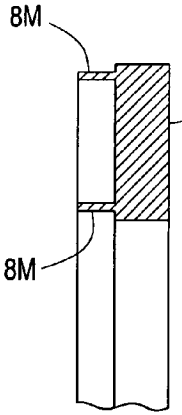
FIG. 37 show a cross sectional-view of the front end cap taken through line 35-35 of FIG. 35.
Figure 36:
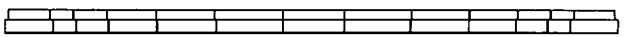
FIG. 36 shows an edge view of the front end cap shown in FIG. 33.

Referring to FIGS. 35-37. These figures show the structure of the front end cap 8 of the optical module 2 of the present invention and, in particular, the pair of spaced male protrusions 8M, 8M for mating with the female grooves 5F, 6F (FIGS. 12 and 16) of the lower and upper shells 5 and 6. The male protrusions 8M, 8M, which are approximately 1/16 inch thick, extend approximately 1/4 inch from the base 8N of the front end cap 8.

Figure 38:
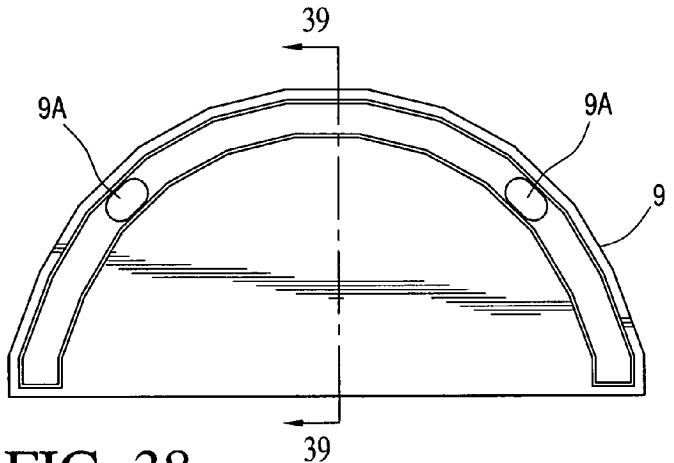
FIG. 38 is a rear view of the rear end cap of the optical module of the present invention.
Figure 39:
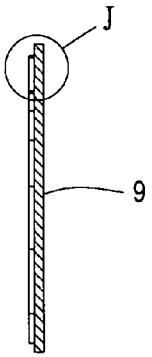
FIG. 39 is a cross-sectional view of the rear end cap taken through lines 38-38 of FIG. 38.
Figure 40:
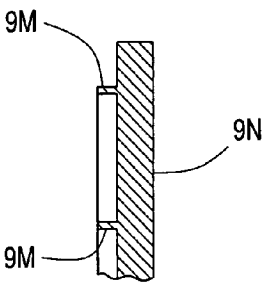
FIG. 40 is an enlargement of the circled area J shown in FIG. 39.
Figure 41:
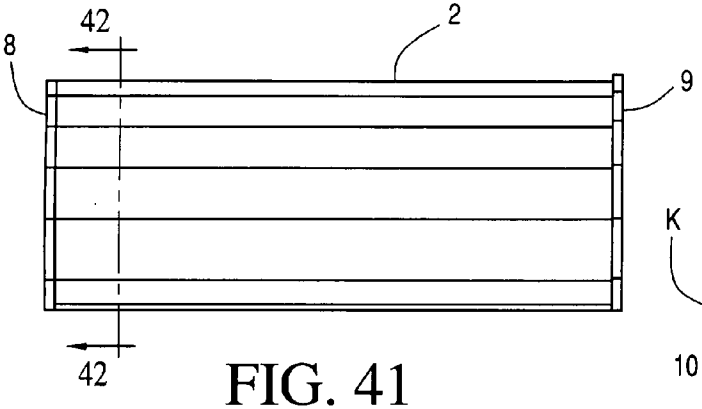
FIG. 41 shows another side view of the optical module of the present invention.

Referring now to FIGS. 38-40. These figures show the structure of the rear end cap 9 of the optical module 2 of the present invention and, in particular, the pair of spaced male protrusions 9M, 9M for mating with a pair of corresponding, spaced, female grooves (not shown) at the rear ends of the lower and upper shells 5 and 6. The male protrusions 9M, 9M extend approximately 1/8 inch from the base 9N of the rear end cap 9. The openings 9A, 9A in the rear end cap 9 allow for the harnesses of the extended electrical leads to pass therethrough.

Figure 42:
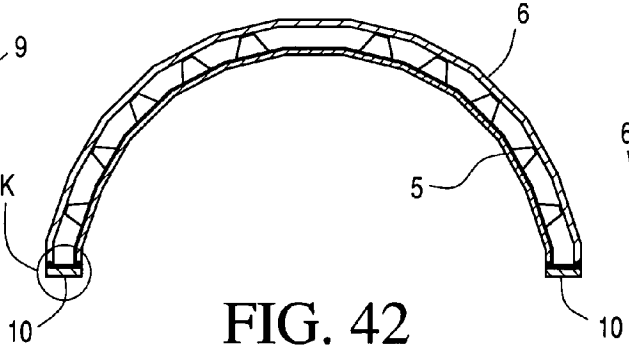
FIG. 42 shows a cross-sectional view taken through line 42-42 of FIG. 41.
Figure 43:
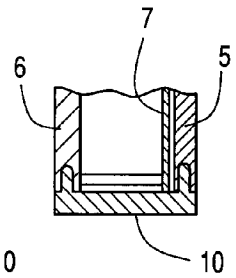
FIG. 43 shows an enlargement of the circled area K in FIG. 42.
Figure 44:
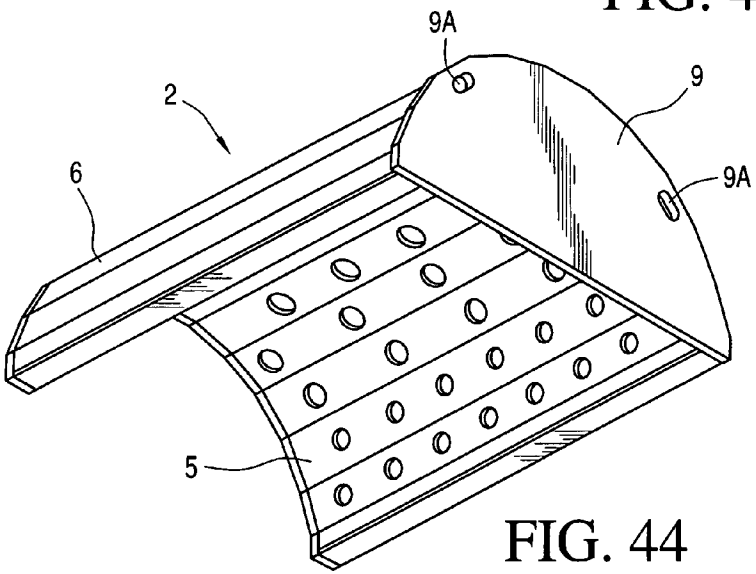
FIG. 44 shows another perspective view of the optical module of the present invention.
Figure 45:
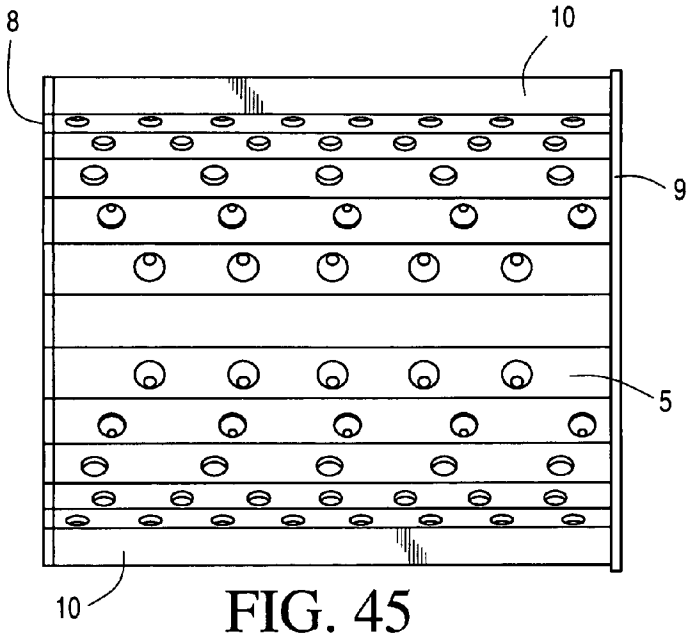
FIG. 45 shows a bottom view of the optical module of the present invention.
Figure 47:
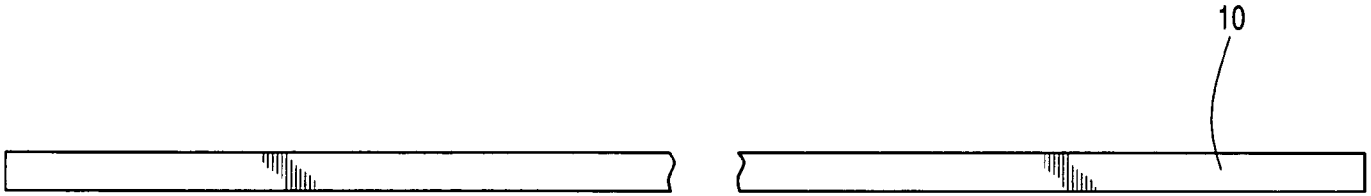
FIG. 47 is a side view of the support bracket shown in FIG. 46.
Figure 46:
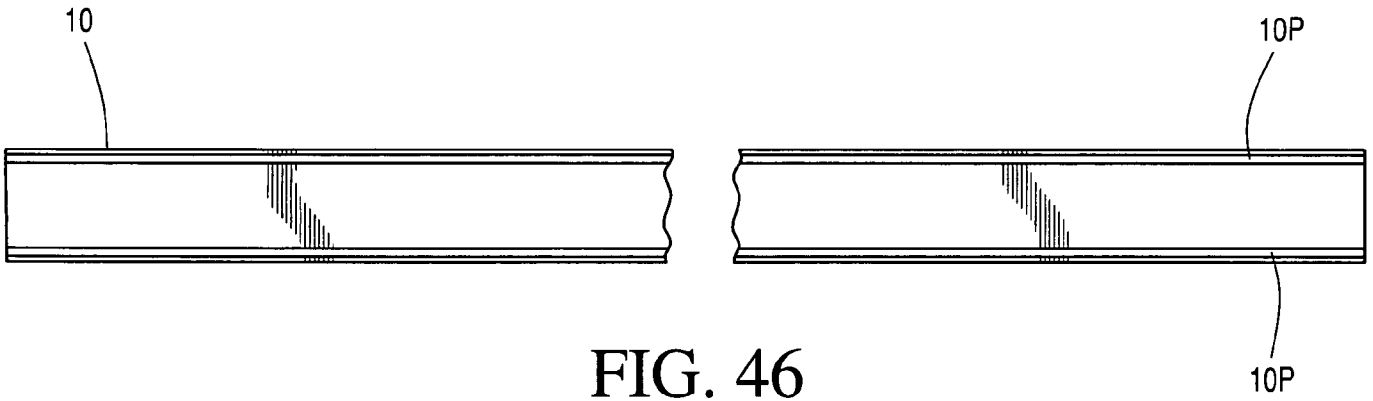
FIG. 46 shows a top planar view of a support bracket for the optical module used in this invention.
Figure 48:
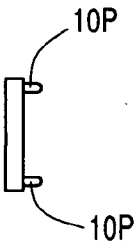
FIG. 48 is an end view of the support bracket shown in FIG. 46.

Referring to FIGS. 41-45. These figures show the assembly of the optical module 2 with its front and rear end caps 8 and 9 and with its supporting assembly brackets 10, 10 attached thereto. In particular, FIG. 42 shows a cross-sectional view taken along line 41-41 of the optical module 2 shown in FIG. 41 with the assembly brackets 10, 10 attached to the bottom ends of the lower and upper shells 5 and 6, respectively. The detail of one of these connections (an enlargement of the circled area K in FIG. 42) is shown in FIG. 43 where the protrusions 10P, 10P of an assembly bracket 10 are inserted within female grooves of the lower and upper shells 5 and 6, respectively. FIG. 44, which shows a perspective view of the optical module 2, also shows a pair of openings 9A, 9A in the rear end cap 9. These openings 9A, 9A provide for the passage of the electrical lead harnesses therethrough to the openings 16A, 16A in the front end cap 16 of the electrical/support housing 3. The structure of one of the elongated assembly brackets 10 is shown in FIGS. 46-48 with the protrusions 10P, 10P extending therefrom and along its entire length.

Figure 49:
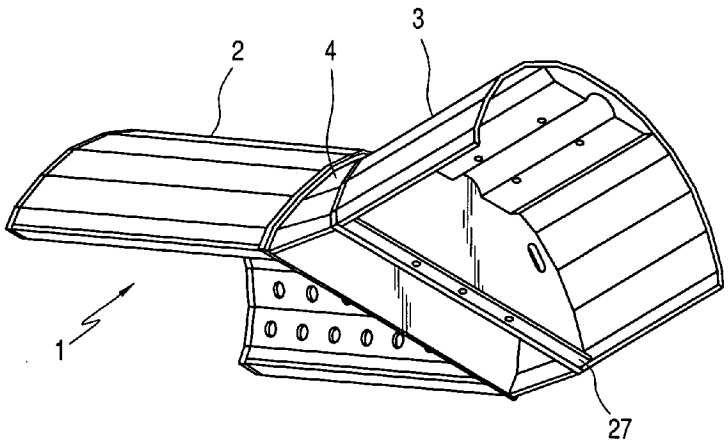
FIG. 49 shows a perspective view of the LED light fixture including the optical module and the support/electronics housing partially broken away.
Figure 50:
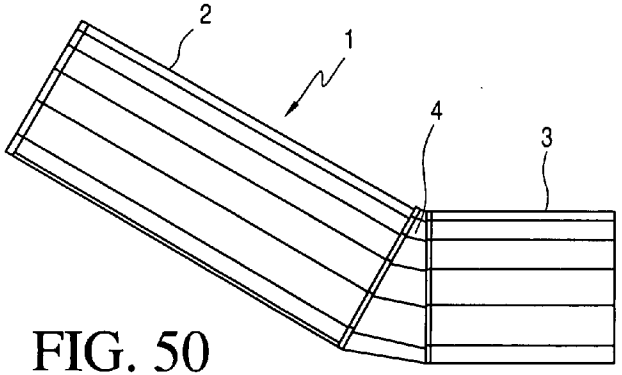
FIG. 50 is a side perspective view of the LED light fixture of this invention.
Figure 51:
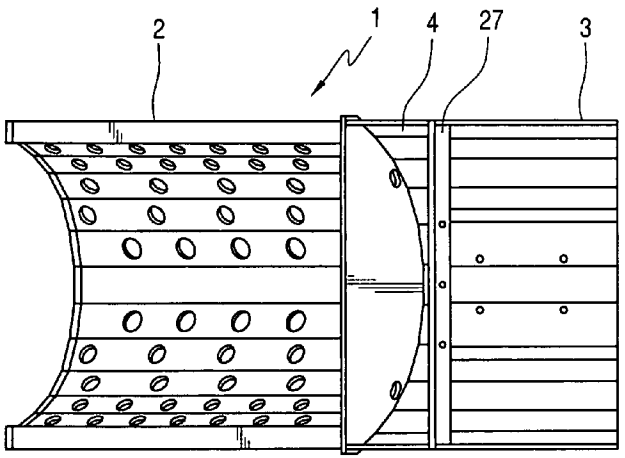
FIG. 51 is a bottom view of the LED light fixture of this invention.

Referring now to FIGS. 49-51. These figures show the assembly of the optical module 2 with the rear housing 3 utilizing an angled inter-connector 4 which is attached to the optical module 2 and to rear housing by means, for example, of a male/female connection between the rear end of the optical module 2 and the front end of the angled inter-connector 4 and of a male/female connection between the rear end of the angled inter-connector 4 and the front end of the housing 3. Both connections are initially pressure fitted and locked therein. The former male/female connection is hermetically sealed and the latter male/female connection is weather proofed. The piano hinge 27, which is attached to the front cap of the electrical/support housing 3 by appropriate screws, is also shown in FIGS. 49 and 51.

Figure 54:
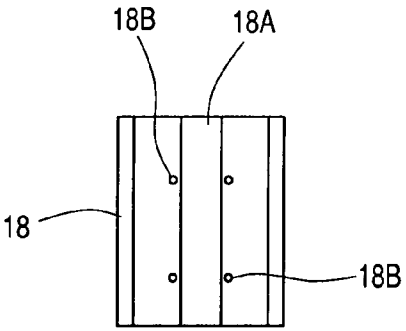
FIG. 54 is a bottom view of the pole support hardware within the support/electronics housing.
Figure 55:
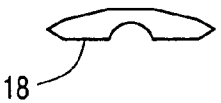
FIG. 55 is a front view of the pole support hardware shown in FIG. 54.

Referring to FIGS. 54 and 55. FIG. 54 shows a bottom view of a pole support structure 18 affixed to the top underside of the housing 3. The support structure 18 has an elongated, semi-cylindrical groove 18A therein and four spaced, predrilled, tapped holes 18B therein. The support structure 18 is a solid metal block preferably made of, for example, aluminum, or some other sturdy metal. For supporting the LED streetlight fixture 1 of this invention a cylindrical extension pole is slid through the opening 17A in the rear end cap 17 of the housing 3, fitted within the groove 18A of the support structure 18, and attached thereto by a pair of opposing semi-cylindrical brackets (not shown) or an elongated, single, semi-cylindrical, opposing bracket (not shown) utilizing the appropriate screws for the four spaced holes 18B.

Figure 52:
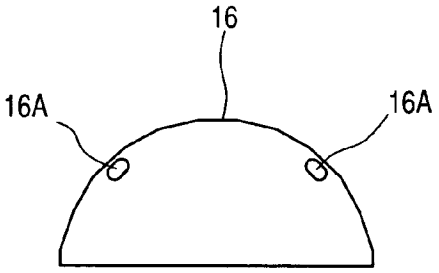
FIG. 52 is a front view of the front cap for the support/electronics housing of the LED light fixture of this invention.
Figure 53:
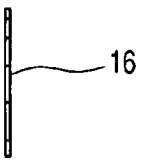
FIG. 53 is an end view of the support/electronics housing shown in FIG. 52.
Figure 56:
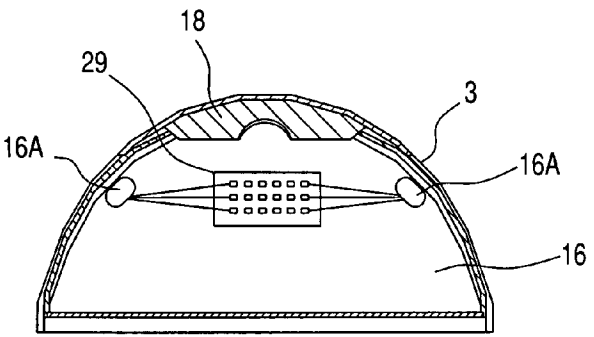
FIG. 56 is a cross-sectional view of the support/electronics housing for the LED light fixture of this invention.

Referring now to FIGS. 52 and 56. These figures show the front end cap 16 for the electrical/support housing 3 with a pair of spaced holes 16A, 16A for passing the electrical lead harnesses therethrough to the electrical control unit 29 in the rear housing 3. The electrical control unit 29, which is shown symbolically in FIG. 56, is fixedly attached to the inner surface of the front end cap 16 of the rear housing 3.

Figure 57:
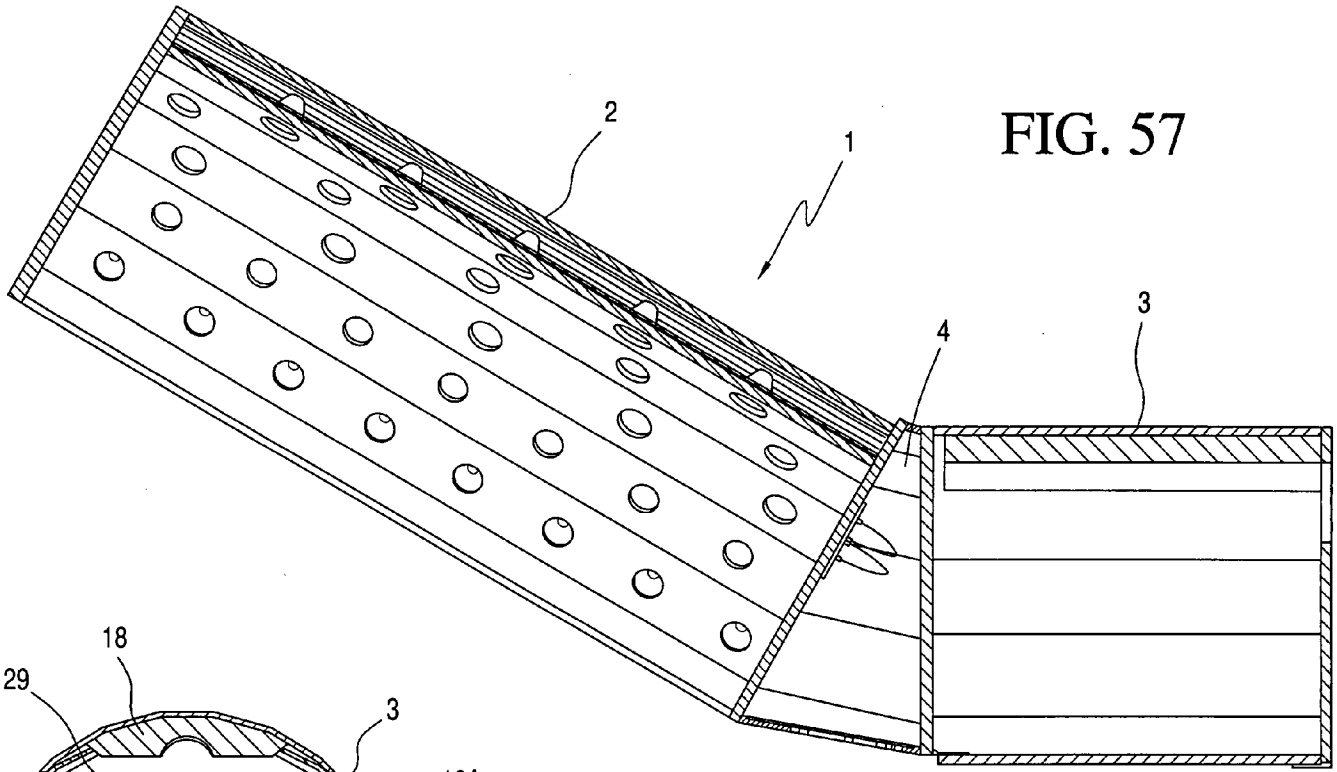
FIG. 57 is a partial perspective view of the LED light fixture of this invention.

FIG. 57 shows a cross-sectional view of the optical module 2 and inter-connector 4 and a partial cross-sectional view of the electrical/support housing 3.

While the invention has been particularly shown and described with reference to preferred embodiments thereof, it will be understood by those skilled in the art that various changes and modifications in form and detail may be made therein without departing from the spirit and scope of the invention.

The invention claimed is:

1. An LED area light fixture comprising a first part and a second part wherein said first part has an elongated, metallic, substantially, semi-cylindrical upper shell and an elongated, metallic, substantially, semi-cylindrical lower shell spaced from said upper shell and wherein said second part is a housing attached to said first part, said upper and lower shells being enclosed and attached at opposite ends by end caps, a printed circuit board (PCB) secured to the underside of said upper shell and supporting an array of spaced, high intensity LEDs, said lower shell having a plurality of spaced openings therein wherein each of said plurality of spaced openings is aligned with a respective one of said LEDs, said lower shell having a counter-sunk hole on its inner side at each of said spaced openings, a light diffusing lens within each of said counter-sunk holes, an elongated, substantially semi-cylindrical, inner shell having a plurality of spaced openings therein with a hollow shaped, light focusing cone secured to said inner shell at each of said spaced openings, each of said hollow shaped, light focusing cones being aligned with a respective opening in said semi-cylindrical lower shell and with a respective high intensity LED in said semi-cylindrical upper shell, each of said hollow shaped, light focusing cones having one end with a smaller opening therein which smaller opening encompasses a respective LED in said array and an opposite end with a larger opening therein which opposite end is secured to said inner shell at a respective opening in said inner shell, a heat dissipative conductive layer being integral with said printed circuit board (PCB) and said array of high intensity LEDs, said second part enclosing electronic circuitry for operating and controlling said LEDs, and said second part including means for supporting said light fixture.

2. The light fixture of claim 1 wherein said upper shell is configured into a plurality of elongated, rectangular sections, said printed circuit board (PCB) being divided into a plurality of spaced, elongated, rectangular strips with a predetermined number of said spaced high intensity LEDs attached to each of said PCB strips, and each of said elongated PCB strips being attached to an inner surface of a respective elongated, rectangular section of said upper shell.

3. The light fixture of claim 2 wherein a predetermined number of said plurality of elongated, rectangular sections in said upper shell are progressively angled with respect to each other, wherein each of said predetermined number of said elongated, rectangular, angled sections has an elongated rectangular groove therein and wherein each of said PCB strips is inserted and fixed within a respective elongated rectangular groove.

4. The light fixture of claim 3 wherein said upper shell has five elongated, rectangular angled sections on one longitudinal side thereof and five elongated, rectangular, angled sections on the opposite longitudinal side thereof.

5. The light fixture of claim 4 wherein said lower shell has a plurality of elongated, rectangular sections, wherein a predetermined number of said plurality of elongated, rectangular sections in said lower shell are progressively angled with respect to each other and wherein each of said predetermined number of said plurality of elongated, rectangular angled sections of said lower shell corresponds with a respective elongated, rectangular, angled section in said upper shell.

6. The light fixture of claim 5 wherein each of said predetermined high intensity LEDs in said plurality of PCB strips is aligned with a respective opening in said hollow shaped cones which, in turn, is aligned with a respective opening in said lower shell.

7. The light fixture of claim 6 wherein said inner shell and said light focusing cones are integrally molded in one piece.

8. The light fixture of claim 7 wherein each of said light diffusing lenses is made from glass or plexiglass.

9. The light fixture of claim 8 wherein each of said light diffusing lenses is pressed into and hermetically sealed in a respective counter-sunk hole in said lower shell.

10. The light fixture of claim 9 wherein each of said light focusing cones is molded out of zinc plated plastic or other appropriate materials such as aluminum.

11. The light fixture of claim 9 wherein each of said light focusing cones and said inner shell are made from aluminum or other materials such as zinc coated plastic.

12. The light fixture of claim 11 wherein each of said LEDs in said array has a domed shaped lens and said smaller opening in each of said hollow shaped cones encompasses and contacts a respective domed shaped lens.

13. The light fixture of claim 12 wherein said opposite end of each of said hollow shaped cones is in contact with a respective light diffusing lens within a respective counter-sunk hole in said lower shell.

14. The light fixture of claim 13 wherein said lower shell, said upper shell, and said end caps are made from aluminum.

15. The light fixture of claim 14 wherein there is a thin copper layer between each of said PCB strips and said upper shell.

16. The light fixture of claim 15 wherein each of said high intensity LEDs has a light output ranging from 90 or more lumens.

17. The light fixture of claim 16 wherein there are ten elongated, rectangular, angled sections in each of said upper, lower and inner shells.

18. The light fixture of claim 17 wherein said upper shell is coated externally with an epoxy powder mixed with fine sand.

19. The light fixture of claim 1 wherein said second part is secured to said first part by an interconnecting structure so as to raise said first part at an acute angle with respect to said second part.

20. The light fixture of claim 19 wherein said acute angle is between approximately zero to 30 degrees.

21. The light fixture of claim 1 wherein said light fixture is for a street light mounted on a support pole.

22. An LED area light fixture comprising an optical module and an electrical/support housing interconnected by an angled structure, said optical module including elongated, substantially semi-cylindrical, upper and lower metallic shells, said upper and lower shells being spaced from each other, an elongated, semi-cylindrical inner shell spaced from said upper shell and secured between said upper and lower shells, said lower shell having a plurality of spaced openings therein, said inner shell having a plurality of spaced openings therein and in alignment with a respective opening in said lower shell, a plurality of light focusing cones attached to the upper surface of said inner shell, each of said light focusing cones having a through-hole therein and in alignment with a respective opening in said inner shell, each of said semi-cylindrical shells being mainly constructed of adjacent, elongated, angled sections on opposite sides of each shell, a plurality of elongated PCB strips, each of said plurality of elongated PCB strips having a plurality of linearly spaced LEDs attached thereto and facing said inner and lower shells, each of said elongated PCB strips being attached to a respective lower surface of each of said adjacent, elongated, angled sections of said upper shell, and each of said plurality of linearly spaced LEDs being in alignment with a respective opening in said inner shell and said lower shell.

23. The light fixture of claim 22 wherein said lower shell has a counter-bore on its upper side at each of said openings therein and a light diffusing lens in each of said counter-bores.

24. The light fixture of claim 23 wherein the larger end of each of said light focusing cones is in contact with a respective light diffusing lens and the smaller end of each of said light focusing cones encompasses a respective LED.

25. The light fixture of claim 24 wherein said angled structure raises said optical module at an acute angle with respect to said electrical/support housing.

26. The light fixture of claim 25 wherein said acute angle is between approximately zero and 30 degrees.

27. The light fixture of claim 26 wherein said light fixture is for area lighting such as a street light mounted on a support pole.

28. An LED street light fixture comprising an optical module and an electrical/support housing interconnected by a structure, said optical module including an elongated, substantially semi-cylindrical, upper metallic shell and an elongated, substantially semi-cylindrical, lower metallic shell spaced from said upper shell, an elongated, substantially semi-cylindrical inner shell spaced and supported between said upper and lower shells, said lower shell having a plurality of spaced openings therein, said inner shell having a plurality of spaced openings therein and in alignment with a respective opening in said lower shell, said inner shell having a plurality of light focusing cones secured thereto, each of said plurality of light focusing cones having a through-hole therein and being aligned with a respective opening in said inner shell, said lower shell having a counter-bore on its upper side at each of said plurality of spaced openings, a light diffusing lens in each of said counter-bores, each of said substantially semi-cylindrical upper, lower and inner shell being primarily constructed of adjacent, elongated, substantially rectangular, angled sections on opposite sides of each shell, a plurality of elongated PCB strips, each of said plurality of elongated PCB strips having a plurality of linearly spaced LEDs attached thereto and facing said inner and lower shells, each of said plurality of elongated PCB strips being attached to a lower surface of a respective angled section of said upper shell, and each of said linearly spaced LEDs being in alignment with a respective opening in said inner shell.

29. The LED street light fixture of claim 28 wherein the inner surface of each of said elongated, angled sections in said upper shell has an elongated groove therein and each of said plurality of elongated PCB strips is secured in a respective elongated groove.

30. The LED street light fixture of claim 29 wherein there is thin, heat conductive, metallic layer between each of said plurality of elongated PCB strips and said upper shell.

31. The LED street light fixture of claim 30 wherein said heat conductive, metallic layer is made of copper or other equivalent heat dissipating materials.

32. The LED street light fixture of claim 31 wherein said inner shell and light diffusing cones are metallic.

33. The LED street light fixture of claim 31 wherein said inner shell and said light diffusing cones are made of zinc plated plastic.

34. The LED street light fixture of claim 33 wherein said upper shell is coated externally with an epoxy powder mixed with sand.

35. The LED street light fixture of claim 28 wherein said electrical/support housing is secured to said optical module by said interconnecting structure so as to raise said optical module at an acute angle with respect to said electrical/support housing.

36. The LED street light fixture of claim 28 wherein an electrical control unit is supported within said electrical/support housing for operating said LEDs and wherein a pole support structure is secured within said electrical/support housing.

37. The LED street light fixture of claim 36 wherein said LEDs in said optical module are connected to said electrical control unit in said housing by electrical harnesses.

38. The LED street light fixture of claim 28 wherein said upper and lower shells are secured and sealed together by end caps.

* * * * *